US008037823B2

(12) United States Patent
Ritchie et al.

(10) Patent No.: US 8,037,823 B2
(45) Date of Patent: Oct. 18, 2011

(54) NETWORKED PYROTECHNIC ACTUATOR INCORPORATING HIGH-PRESSURE BELLOWS

(75) Inventors: Robert S. Ritchie, Newhall, CA (US); Steven David Nelson, Huntington Beach, CA (US); Michael N. Diamond, Thousand Oaks, CA (US)

(73) Assignee: Pacific Scientific Energetic Materials Company, Valencia, CA (US)

( * ) Notice: Subject to any disclaimer, the term of this patent is extended or adjusted under 35 U.S.C. 154(b) by 0 days.

(21) Appl. No.: 12/844,214

(22) Filed: Jul. 27, 2010

(65) Prior Publication Data

US 2010/0288148 A1 Nov. 18, 2010

Related U.S. Application Data

(62) Division of application No. 11/657,723, filed on Jan. 25, 2007, now Pat. No. 7,762,189.

(60) Provisional application No. 60/882,856, filed on Dec. 29, 2006.

(51) Int. Cl.
*F42B 3/10* (2006.01)

(52) U.S. Cl. ..... 102/202.5; 102/202.7; 102/206; 102/215; 102/340; 102/351; 102/357; 102/530; 89/1.14; 244/54

(58) Field of Classification Search ..... 102/202.5, 102/202.7, 206, 215, 340, 342, 351, 357, 102/377, 378, 530, 531, 335; 89/1.14; 244/54, 244/138

See application file for complete search history.

(56) References Cited

U.S. PATENT DOCUMENTS

| | | | | | |
|---|---|---|---|---|---|
| 3,672,303 | A * | 6/1972 | Brawn | 102/220 |
| 3,851,587 | A * | 12/1974 | Alchorn et al. | 102/275.8 |
| 4,148,257 | A * | 4/1979 | Orrill et al. | 89/1.14 |
| 4,669,354 | A * | 6/1987 | Lucy | 89/1.14 |
| 5,431,015 | A * | 7/1995 | Hein et al. | 60/581 |
| 5,585,596 | A * | 12/1996 | Richards et al. | 102/378 |
| 6,220,165 | B1 * | 4/2001 | Sullivan | 102/206 |
| 6,283,227 | B1 * | 9/2001 | Lerche et al. | 175/4.55 |
| 6,584,907 | B2 * | 7/2003 | Boucher et al. | 102/217 |
| 7,063,019 | B2 * | 6/2006 | Parks et al. | 102/202.9 |
| 7,188,558 | B2 * | 3/2007 | Brede et al. | 89/1.14 |
| 7,419,184 | B2 * | 9/2008 | Green et al. | 280/743.2 |
| 7,762,189 | B2 * | 7/2010 | Ritchie et al. | 102/202.7 |
| 2004/0007123 | A1 * | 1/2004 | Ritchie et al. | 89/1.14 |
| 2005/0188875 | A1 * | 9/2005 | Matsuda et al. | 102/206 |

* cited by examiner

*Primary Examiner* — Michael David
(74) *Attorney, Agent, or Firm* — Perkins Coie LLP

(57) ABSTRACT

A pyrotechnically powered actuator having a bellows that provides a force and stroke upon initiation is disclosed. The actuator includes a housing body with a first end and a second end. The bellows is coupled to the first end of the housing body. A cover is coupled to the second end of the housing body. An initiator is located within the housing body and includes a pyrotechnic material and a bridge element. The housing body, the bellows, and the cover define a hermetically sealed chamber. The bellows is compact, lightweight, and can withstand internal and external pressure at least as high as 3,000 psi. An exemplary embodiment includes a housing body that provides a compartment for adding supplemental pyrotechnic material. Further exemplary embodiments of the actuator include a chip initiator that requires less than 1 amp to function in less than 10 milliseconds.

15 Claims, 9 Drawing Sheets

NETWORKED PYROTECHNIC ACTUATOR INCORPORATING HIGH-PRESSURE BELLOWS

CROSS-REFERENCE TO RELATED APPLICATION

This application is a divisional of U.S. patent application Ser. No. 11/657,723 filed Jan. 25, 2007, which claims priority to and incorporates by reference in its entirety U.S. Provisional Application No. 60/882,856 filed Dec. 29, 2006, titled "NETWORKED PYROTECHNIC ACTUATOR INCORPORATING HIGH-PRESSURE BELLOWS".

TECHNICAL FIELD

The following relates to a pyrotechnic actuator, and more particularly, a networked pyrotechnic actuator incorporating high-pressure bellows.

BACKGROUND

An actuator is a mechanical, pneumatic, hydraulic, or electrical device that moves a body from an initial position to a subsequent position in response to a signal. Actuators are used in numerous applications. For instance, an actuator may be used as a switch that closes a circuit when a conductive body of the actuator moves from an initial position to a subsequent position. An actuator also may be used as a valve that shuts off fluid flow in a channel when a valve body of the actuator moves from an initial position to a subsequent position.

Pyrotechnically powered actuators have been used in missiles, launch vehicles, spacecraft, and many other applications. In this context, actuators can be used for igniting, moving, separating or activating various elements. Generally, pyrotechnic actuators are fired (triggered) by electro-pyrotechnic components in which at least one phase involves the rapid decomposition of pyrotechnic substances at high pressure and temperature. These devices typically use pressure cartridges or explosive charges to provide the high pressure, high temperature gases to move a piston to a desired stroke.

FIG. 7 presents a cross-sectional side view of a known pyrotechnic actuator 700 having a piston assembly. Actuator 700 includes a housing body 708 that receives a piston 710 and an initiator 706, which is an igniting system. Piston 710 is held in place within housing body 708 by a shear pin 712 that protrudes through piston 710 and housing body 708. Initiator 706 includes a cover 720 having holes through which leads 702*a* and 702*b* extend and an inner surface upon which a wire bridge element (not shown) is attached such that it contacts leads 702*a* and 702*b*. An end of each of leads 702*a* and 702*b* is attached to a power source (not shown). Initiator 706 is filled with pyrotechnic material. During initiation the power source is energized, which causes the leads to trigger the wire bridge element, igniting the pyrotechnic material. This ignition causes the rapid expansion of gas, which results in extremely high pressure within housing body 708.

O-ring 704 provides a tight seal around a head 716 of the piston 710 to maintain pressure in housing body 708 between head 716 and cover 720 after initiation. Pressure must be maintained behind head 716 so that high pressure produced by initiation forces head 716 to move piston 710 quickly and with enough force to break shear pin 712. Dotted lines 714 illustrate the stroke provided by piston 710 upon initiation. The movement of piston 710 is confined to the distance head 716 can move within housing body 708.

In addition to o-ring 704, actuator 700 requires close tolerances, allowing only a small difference between maximum and minimum limits of each dimension, so as to create a seal. Tight seals are important because high pressures can cause blow-by, contamination, and leakage, which can cause potentially catastrophic results.

Another type of actuator uses expanding bellows that move from an initial, shorter position to a final, expanded position. Typically, bellows have been made of brass or gilding metal, which tend to rupture under internal or external pressure under 2,000 psi. Conventional bellows tend to deform in multiple directions as a result of high internal pressure, which causes an irregular stroke.

Referring again to FIG. 7, in a conventional pyrotechnically powered actuator, leads 702*a* and 702*b* supply a relatively large current for triggering the actuator. A typical pyrotechnically powered actuator requires a minimum of 3.5 amps of power for at least 10 ms to function reliably. The bridge is generally large and requires a relatively high threshold current to be tolerant of stray currents and voltages throughout the system that otherwise could cause false triggers. In this manner, the bridge dissipates these currents. As a result, initiators for conventional pyrotechnic actuators typically are large and heavy. Complex systems may include many initiators, which often require large and heavy cables, controllers and batteries. The cables used are typically at least as large as 18 gauge to be sufficient to carry large transient currents of one to five amps during firing. In the aggregate, the large number of high-power shielded cables required for the branching configuration of actuators are heavy and occupy significant volume, resulting in weight and packaging difficulties within an aircraft, spacecraft, missile, launch vehicle or other application where weight and space are at a premium. Accordingly, this increase in pyrotechnic system weight and volume, coupled with the pressure limits discussed above, presents difficulties may require significant engineering time to solve.

SUMMARY

A pyrotechnically powered actuator is disclosed having an integrated body and a bellows coupled thereon that provides a force and stroke upon initiation. An initiator is hermetically sealed within the housing body and includes a pyrotechnic material and a bridge element. The bellows is compact, and lightweight, but is made of a high yield material to withstand high internal and external pressures. The initiator may further include an integrated circuit with a logic device that triggers the pyrotechnic reaction based upon receiving an external digital signal.

An actuator is disclosed that comprises a chamber having an opening, a bellows coupled to the chamber at the opening, and an initiator located within the chamber. The initiator includes circuitry connected to at least one lead extending outside the actuator, a bridge element connected to the circuitry, and a pyrotechnic material connected to the bridge element.

Additionally, an actuator is disclosed that includes a chamber and a bellows coupled to the chamber that includes a threaded boss at an end for coupling to a tool. The actuator includes an initiator located within the chamber that further includes a pyrotechnic material and a bridge element.

An actuator is also disclosed that comprises a housing body having a first end and a second end, wherein the first end has a closure. A bellows is coupled to the first end of the housing body, and a cover coupled to the second end of the housing body. An initiator is located within the housing body, wherein the initiator comprises a receptacle containing an amount of pyrotechnic material and a bridge element. The housing body comprises a compartment having a first end defined by the initiator and a second end defined by the closure.

BRIEF DESCRIPTION OF THE DRAWINGS

Additional embodiments will be more apparent upon consideration of the following detailed description, taken in conjunction with the accompanying drawings, in which like reference characters refer to like parts throughout, and in which.

DETAILED DESCRIPTION

Figure 1B:
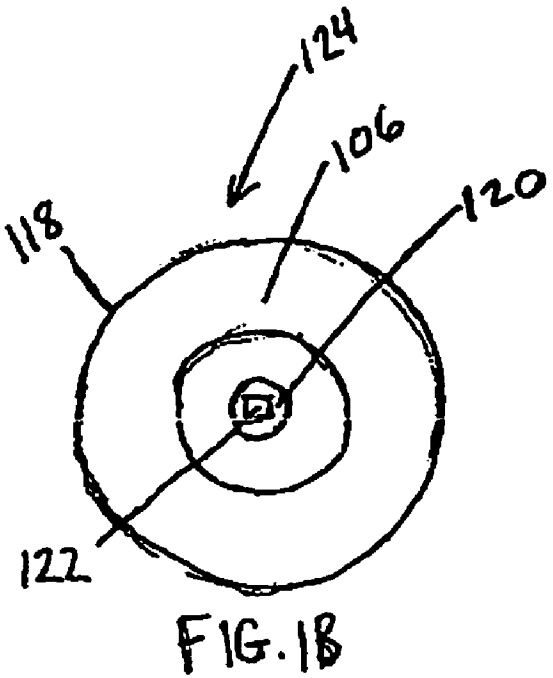
FIG. 1B is a front view of an integrated circuit chip initiator incorporated in the actuator assembly of FIG. 1A.
Figure 1A:
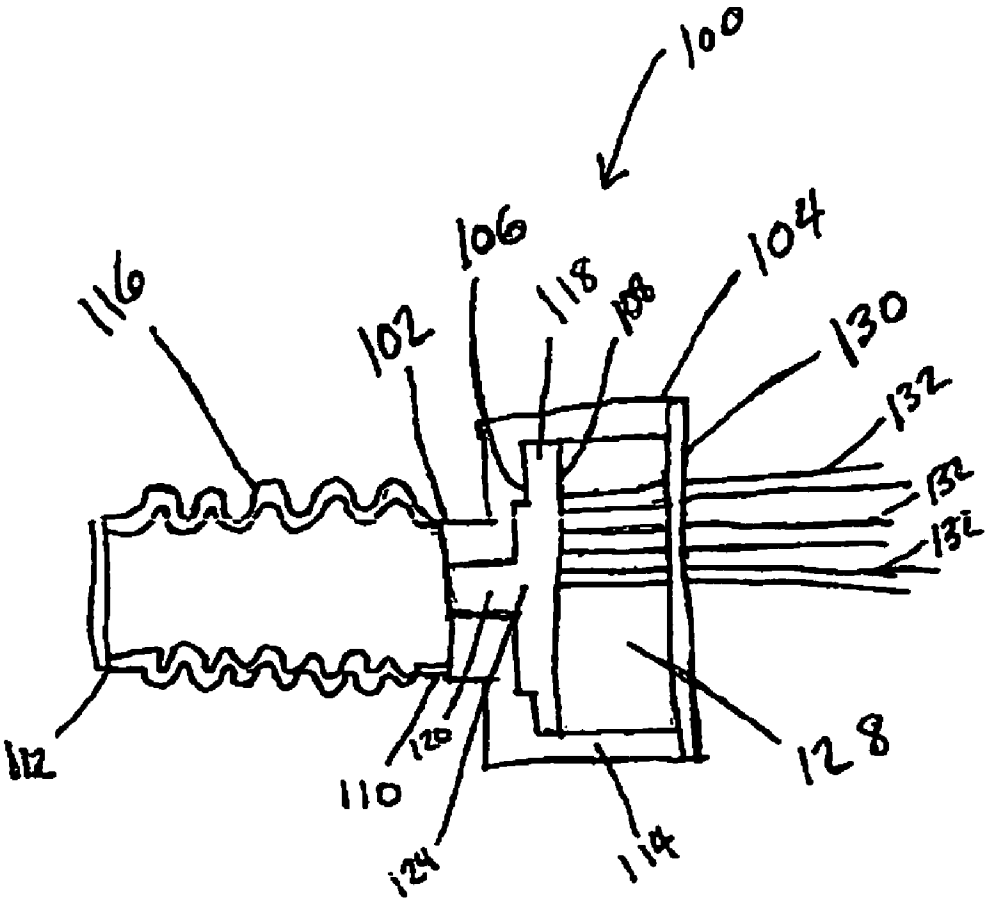
FIG. 1A illustrates a cross-sectional side view of an embodiment of the actuator assembly.

The following describes a lightweight, highly compact pyrotechnic actuator that can withstand high internal and external pressure. The details included herein are for the purpose of illustration only and should not be understood to limit the scope of the disclosure. Moreover, certain features that are well known in the art are not described in detail to avoid complication of the subject matter described herein.

In an exemplary embodiment, the pyrotechnically powered actuator can include a bellows comprised of a high yield, high tensile strength material capable of withstanding high internal and external pressures. When triggered, the bellows actuates from pyrotechnic material associated with an initiator in an integrated, sealed housing capable of withstanding high pressure without deformation.

In a further embodiment, the initiator sealed within the actuator housing may include an integrated circuit with a logic device for receiving digital commands at low voltage and low current. The integrated circuit can be configured with a unique identifier that may be pre-programmed or assigned when a networked actuator system is powered up. By triggering from an integrated circuit as opposed to a conventional analog system, the system can be powered without a heavy, large power source, without heavy cables, and with a smaller, lighter bridge element.

An actuator that combines high yield, high tensile strength bellows with an integrated circuit-based initiator can be 20% of the weight of a conventional actuator. The compact size and light weight provides a significant advantage in systems that fly and/or travel at rapid speeds, such as satellites or missiles. By incorporating bellows that can withstand high internal and external pressures, the actuator is particularly useful for valve applications.

In additional exemplary embodiments, the actuator housing body includes a flange and a threaded portion for incorporating the actuator into another structure. Optionally, the actuator may also include a tool or a threaded boss at an end of the bellows, so that the actuator may function in a variety of systems. For instance, the actuator may be used as a valve actuator, cutter, or puncturing device. The end of the bellows may not require a tool to function in certain systems. For instance, the end of the bellows may be flat when the actuator is used as a switch actuator or thruster.

FIGS. 1A-G illustrate an exemplary embodiment of an actuator assembly 100, which includes a housing body 114, an initiator 124, and a bellows 116. Housing body 114 may be hollow, and may be coupled to bellows 116 at an end 102. An integrated circuit initiator 124 may be placed within the housing body and sealed therein at end 104. The shape of the housing body interior may be complimentary to the initiator 124 such the initiator 124 sits flush therein. A cover 130 may seal end 104 of housing body 114 to enclose initiator 124.

Bellows 116 may be a rigid, corrugated, hollow cylinder made of a high yield, high tensile strength material. As an example, the bellows may be comprised of stainless steel, or a substance containing stainless steel. The bellows may be designed of a material having a yield strength as high as 60,000 psi or more, and an ultimate tensile strength as high as 80,000 psi or more. As a further example, the bellows may be comprised of INCONEL 718, having a yield strength range of 150,000-160,000 psi and an ultimate tensile strength range of 180,000-200,000 psi. The high yield strength and high ultimate tensile strength of bellows 116 allows it to withstand at least 3,000 psi, and possibly 10,000 psi or more of internal or external pressure without rupturing or having irregular deformation. Bellows 116 expands along its cylindrical axis, providing a stroke, when enough internal pressure is applied. The higher the internal pressure, the more bellows 116 expands. Since bellows 116 can withstand high internal pressures, it may be expanded 100% such that the folds of bellows 116 are straightened. The material of bellows 116 allows it to be completely expanded along its longitudinal axis without rupturing. When an external pressure at least 10,000 psi is applied to bellows 116, it does not rupture or deform, which is a valuable property in applications in which bellows 116 must hold its shape after it has expanded. For instance, when actuator assembly 100 is used as a valve, after bellows 116 is extended into a conduit to stop fluid flow, bellows 116 is not deformed by external fluid pressure as high as 10,000 psi acting upon bellows 116. The ability of bellows 116 to withstand high external pressure is also beneficial when actuator assembly 100 is used in a vacuum.

Actuator assembly 100 may have an integrated circuit chip initiator 124, which can include a plate 118 having a printed circuit board on one side 108 and a bridge element 122 and a receptacle 120 on the other side 106. Additional detail concerning an integrated circuit initiator 124 can be found in U.S. patent application Ser. No. 09/656,325, entitled "Networked Electronic Ordnance System," the disclosure therein is hereby incorporated by reference.

Figure 5:
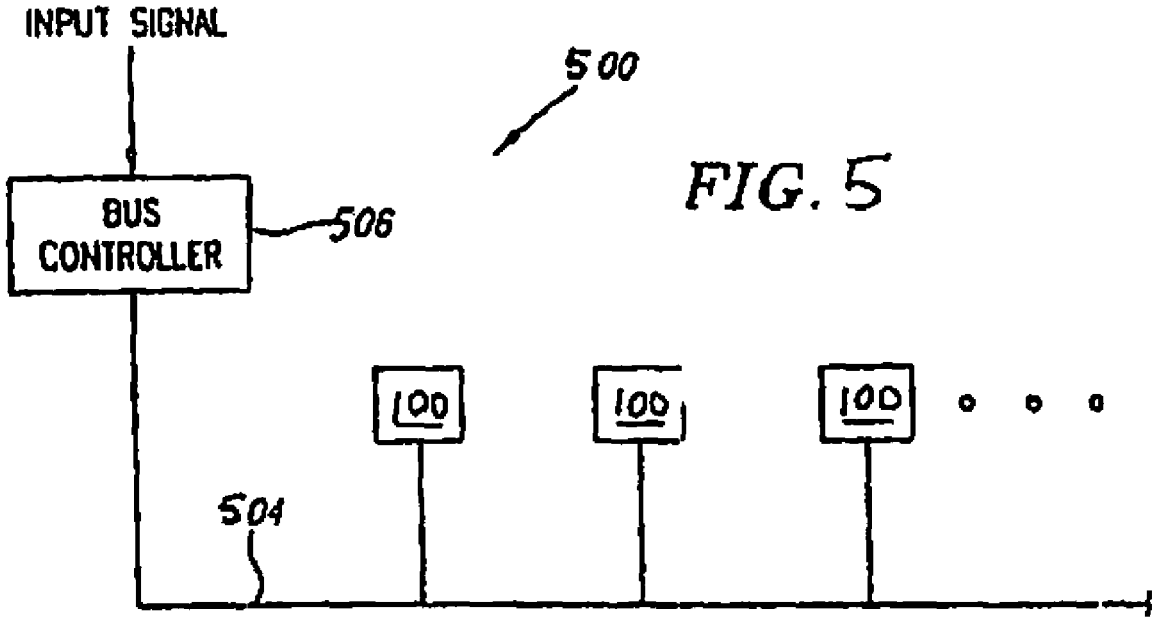
FIG. 5 is a cross-sectional side view of a prior art pyrotechnic actuator having a piston assembly.

FIG. 5 illustrates an exemplary embodiment of a networked electronic system 500 for controlling integrated circuit initiators 124 of a plurality of actuator assemblies 100. This can include a number of actuator assemblies 100 interconnected by a cable network 504, which may be referred to as a bus. The bus 504 also connects the initiators to a bus controller 506. The bus controller can selectively control the devices using lighter and less voluminous cabling in an efficient network architecture. Combined with the compact, lightweight bellows 116, the integrated circuit chip initiator 124 provides more control over actuator assembly 100 with a significant savings in size and weight. As described above, the added functionality combined with less size and weight enhances performance in systems that are flown or are propelled at rapid speeds, such as satellites or missiles.

Figure 6:
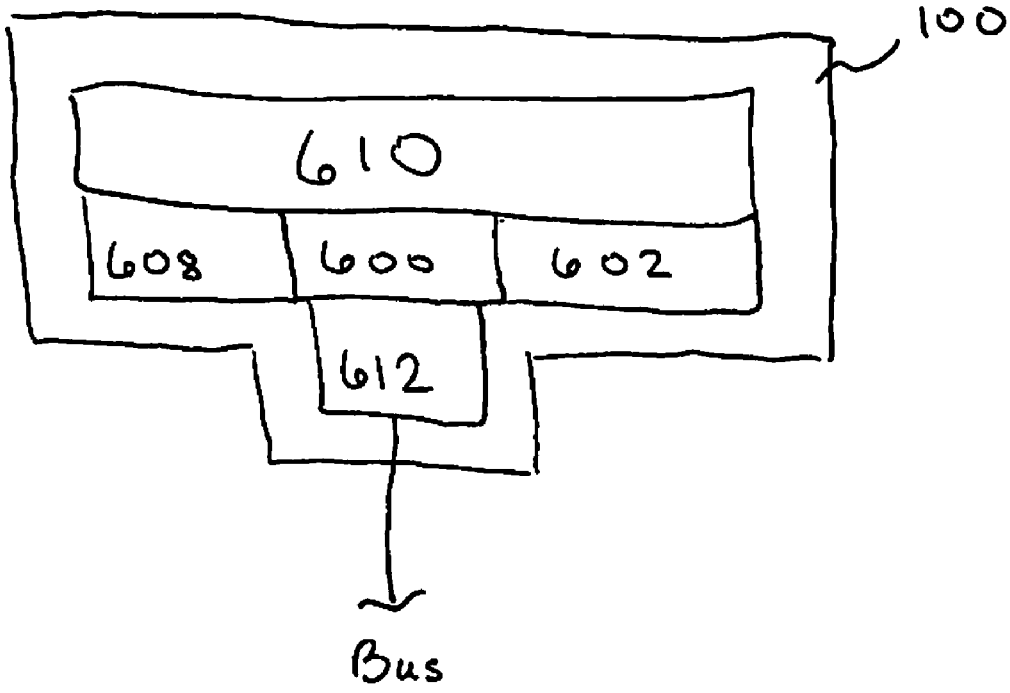
FIG. 6 is a schematic diagram of a actuator including an initiator having an integrated circuit.
Figure 7:
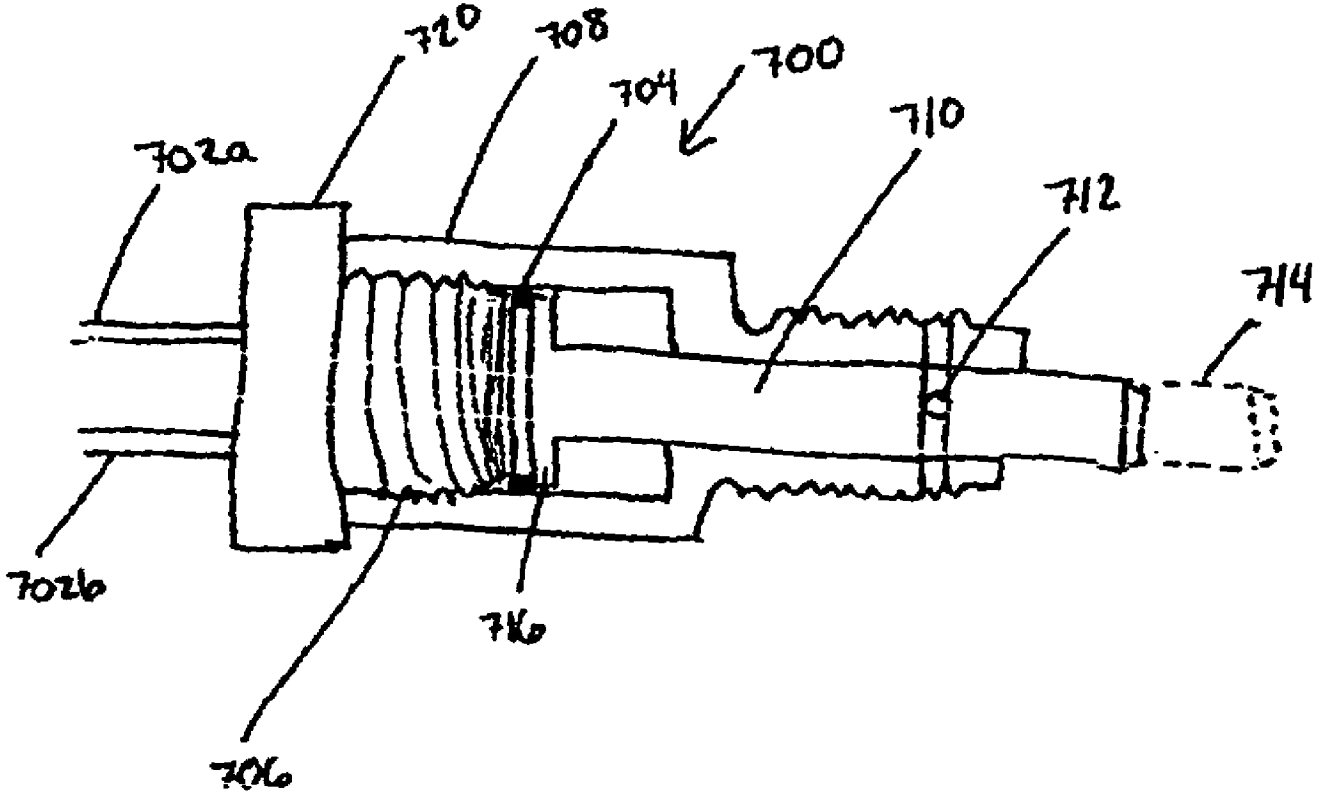
FIG. 7 PRIOR ART
FIG. 7 is a view of a known actuator assembly.

FIG. 6 illustrates a signal path within actuator assembly 100. The actuator assembly 100 may include a logic device 600 and a bus interface 612 to enable connection to the cable network 504. If the bus interface 612 is not included, then the logic device 600 may be connected directly to the cable network 504. Chip initiator 124 within actuator assembly 100 preferably includes an electronic assembly 608 and a pyrotechnic assembly 610. The pyrotechnic assembly 610 contains pyrotechnic material, and the electronic assembly 608 receives firing energy and directs the energy to the pyrotechnic assembly 610 for firing. The electronic assembly 608 may include an energy reserve capacitor (ERC) 602.

FIG. 1B illustrates the location of bridge element 122 positioned within receptacle 120. In a preferred embodiment, bridge element 122 requires less than 1 amp to initiate and is located inside receptacle 120, which receives the pyrotechnic material. Bridge element 122 may include but is not limited to a foil bridge. The pyrotechnic material may include but is not limited to zirconium potassium perchlorate (ZPP).

Referring to FIG. 6, as described above, logic device 600 within each actuator assembly 100 is preferably an application-specific integrated circuit (ASIC). However, the logic device 600 may be any other appropriate logic device, such as but not limited to a microprocessor, a field-programmable gate array (FPGA), discrete logic, or a combination thereof.

Each logic device 600 may have a unique identifier. A unique identifier may be a code stored as a data object within the logic device. The identifier can be permanently stored within the device 600 or may be assigned by the bus controller 506, possibly upon power up. The unique identifier may be digitally encoded using any addressing scheme desired. By way of example and not limitation, the unique identifier may be defined as a single bit within a data word having at least as many bits as the number of actuator assemblies 100 in the networked electronic ordnance system 500, where all bits in the word are set low, except for one bit set high. In this manner, the position of the high bit within the word serves to uniquely identify a single logic device 600. Other unique identifiers may be used, if desired, such as but not limited to numerical codes or alphanumeric strings.

A digital command signal may be transmitted from the bus controller 506 to a specific logic device 600 by including an address field, frame or other signifier in the command signal identifying the specific logic device 600 to be addressed. By way of example and not limitation, referring back to example above of a unique identifier, a command signal may include an address frame having the same number of bits as the identifier word. All bits in the address frame are set low, except for one bit set high. The position of the high bit within the address frame corresponds to the unique identifier of a single actuator assembly 100. Therefore, this exemplary command would be recognized by the logic device having the corresponding unique identifier. As with the unique identifier, other addressing schemes may be used, if desired, as long as the addressing scheme chosen is compatible with the unique identifiers used.

The addressing scheme preferably may be extended to allow the bus controller 506 to address a group of pyrotechnic devices 602 at once, where that group ranges from two pyrotechnic devices 602 to all of the pyrotechnic devices 602. By way of example and not limitation, by setting more than one bit to high in the address frame, a group of actuator assemblies 100 may be triggered, where the logic device 600 in each actuator assembly 100 in that group has a unique identifier corresponding to a bit set to high in the address frame. As another example, an address frame having all bits set low and no bits set to high may constitute an "all trigger" signifier, where each and every logic device 600 is programmed to recognize a command associated with all-fire signifier and fire its associated actuator assembly 100. Other group triggering schemes and all trigger signals may be used if desired.

Chip initiator 124 provides built-in-test capability, which is a self test feature that monitors, isolates, and identifies system problems automatically. In a preferred embodiment the bus controller 506 periodically queries each actuator assembly 100 to determine if the firing bridge in each actuator assembly 100 is intact. The frequency of such periodic queries depends upon the specific application in which the networked electronic ordnance system 500 is used. For example, the bus controller 506 may query each actuator assembly 100 every few milliseconds in a missile application where the missile is en route to a target, or every hour in a missile application where the missile is attached to the wing of an aircraft. Preferably, the bus controller 506 performs this query by transmitting a device test command to each actuator assembly 100. In a preferred embodiment, the device test is as described above, and allows a device test command to be transmitted to one or more specific actuator assemblies 100. Thus, each logic device 600 to which the test signal is addressed receives the test signal, recognizes the address frame and test command, and performs the request test. After the test is performed in an actuator assembly 100, the logic device 600 in that actuator assembly 100 preferably responds to the bus controller 506 by transmitting test results over the network 504. The bus controller 506 may then report test results in turn to a central vehicle control processor (not shown) or may simply record that data internally or display it in some manner to an operator or user of the networked electronic ordnance system 500.

Preferably, one test that is performed is a test of the integrity of the firing element within each chip initiator 124. The firing element is bridge element 122. Determining whether the firing element is intact in each chip initiator 124 is important to verifying the continuing operability of the networked electronic ordnance system 500. Further, repair of actuator assemblies 100 having chip initiators 124 with damaged firing elements is facilitated by determining which specific firing element or elements have failed. The bus controller 506 issues a test signal to one or more specific actuator assemblies 100, where that test signal instructs each receiving actuator assembly 100 to test the integrity of the firing element. The logic device 600 within each actuator assembly 100 to which the test signal is addressed receives the test signal, recognizes the address frame and test command, and tests the integrity of the firing element. In a preferred embodiment, the integrity of the firing element is tested by passing a small controlled current through it. After the test is performed in an actuator assembly 100, the logic device 600 in that actuator assembly 100 responds to the bus controller 506 by transmitting test results over the network 504. In a preferred embodiment, the possible outcomes of the test are: resistance too high, resistance too low, and resistance range. If the resistance is too high, the bus controller 506 infers that the firing element is broken such that current will not flow through it easily, if at all. If the resistance is too low, the bus controller 506 infers that the firing element has shorted out. If the resistance is in range, the bus controller 506 infers that the firing element is intact. The bus controller 506 may the report test results in turn to a central vehicle control processor (not shown) or may simply record that data internally or display it in some manner to an operator or user of the networked electronic ordnance system 500.

Another built-in test function, which is preferably performed by the bus controller 506 is determination of the status of the network 504. In a preferred embodiment, network status is determined by sending a signal over the network 504 to one or more of the pyrotechnic devices 502, which then echo the command back to the bus controller 506 or transmit a response back to the bus controller 506. That is, the bus controller 506 may ping one or more of the pyrotechnic devices 502. If the bus controller 506 receives the expected response within the expected time, it may be inferred that the network 504 is operational and that normal conditions exist across the network 504. If such response is not received, it may be inferred that either the pyrotechnic device 502 which was pinged is not functioning properly or that abnormal conditions exist on the network 504. The bus controller 506 may also sense current drawn by the bus, or bus voltage, to determine if bus integrity has been compromised. Other methods of testing the status of the network 504 are known to those skilled in the art.

In a preferred embodiment, electric power transmission and signal transmission can preferably occur over the same cable, or bus, in the network, thereby eliminating any need to provide separate power and signal cables. The cable network can be built from twisted shielded pair cable, as small as 28 gauge, or the cable may be a flat ribbon cable or any other wiring capable of carrying low voltage and current power and signals.

Bridge element 122 only requires milliamps of power for less than 10 milliseconds to function. Conventional initiators typically require a minimum of 3.5 amps of power for 10 milliseconds for initiation. The weight of the actuator is 20% of the weight of a conventional actuator. The weight of the controller and power source for chip initiator 124 is 10% of the weight of a controller and power source for a conventional initiator. When a plurality of actuators act in a sequence, conventional initiators require a large power supply, such as multiple automotive batteries, while the chip initiator only requires a small power supply, such as AA batteries. The circuit board includes a capacitor discharge circuit that can be charged (armed) or discharged (safed), which results in low power for initiation.

Prior to inserting initiator into housing body 124, end 110 of bellows 116 is coupled to housing body 114 at end 102. This attachment may be achieved by laser welding, but any other method of attachment that provides a strong, hermetic seal may be used. End 110 is open and end 112 is closed by a cover, which may be coupled to bellows 115 by welding or any other method of attachment that provides a strong, hermetic seal.

Figure 1C:
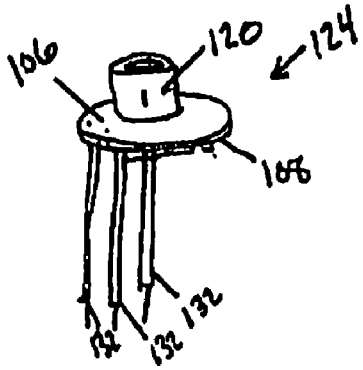
FIG. 1C is a plan view of the chip initiator of FIG. 1A with attached leads.
Figure 1D:
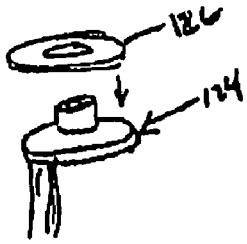
FIG. 1D is a plan view of the chip initiator of FIG. 1A with an attached washer.
Figure 1E:
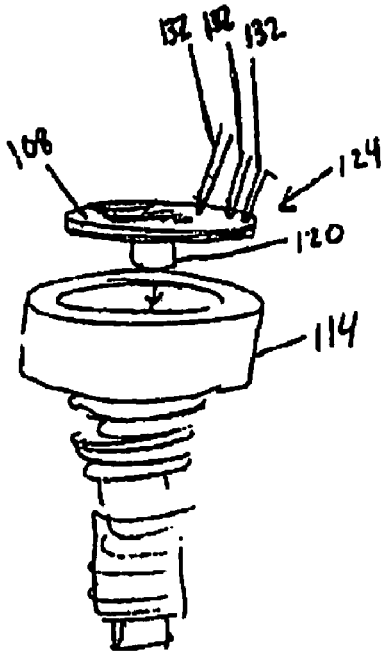
FIG. 1E is a plan view of the chip initiator of FIG. 1A loaded into a housing body of the actuator assembly of FIG. 1A.
Figure 1F:
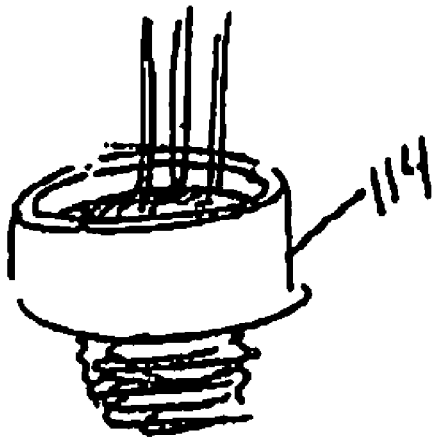
FIG. 1F is a plan view of the housing body of FIG. 1A loaded with filler material.
Figure 1G:
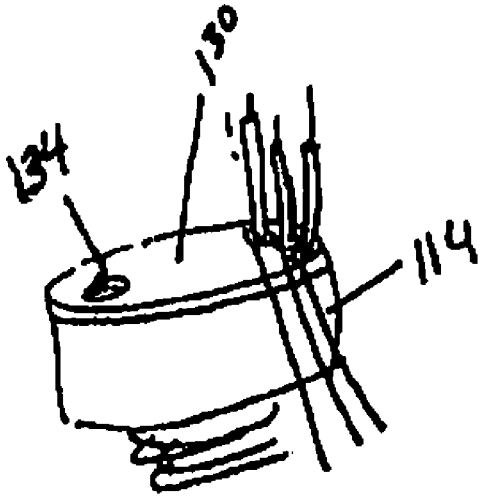
FIG. 1G is a plan view of the housing body of FIG. 1A with a cover attached.

After bellows 116 is attached to housing body 124, receptacle 120 is loaded with pyrotechnic material and the leads 132 are attached to side 108, as illustrated in FIG. 1C. Then, a washer 126 is applied adjacent plate 118, as illustrated in FIG. 1D. (The material of washer 126 includes but is not limited to MYLAR.) Next, chip initiator 124 is inserted into end 104 of housing body 114 with side 106 inserted into housing body 114 first, as illustrated in FIG. 1E. As illustrated in FIG. 1F, the space between chip initiator 124 and end 104 is potted with a filler material 128, which includes but is not limited to epoxy. As illustrated in FIG. 1G, end 104 of housing body 114 is then enclosed by a cover 130, which has lead holes that allow the leads 132 of chip initiator 124 to extend through cover 130. The method of attaching cover 130 to housing body 114 includes but is not limited to welding. The cover also has a fill hole 134 separate from the lead holes. Fill hole 134 provides an opening through which more filler material 128 may be loaded into housing body 114 between chip initiator 124 and cover 130. The filler material ensures that the area between chip initiator 123 and cover 130, including the area between the lead holes and the leads 132, is hermetically sealed.

Housing body 114 and cover 130 may be made from the same material as bellows 116. Since the material of bellows 116 is capable of withstanding at least 3,000 psi of pressure without rupturing, and possibly up to 10,000 psi, all of actuator 100 is capable of withstanding at least 3,000 psi when housing body 114 and cover 130 are made of the same material as bellows 116. The hermetic sealing between bellows 116, housing body 114, and cover 130 and the low number of parts contribute to actuator 100 being successful in maintaining pressure without rupturing. Due to the hermetic sealing between bellows 116, housing body 114, and cover 130, there is no post trigger leakage, contamination, or outgassing.

In operation, when initiator receives a signal, it ignites the pyrotechnic material. The ignition causes gas inside bellows 116 to rapidly expand. The high pressure resulting from the expansion of the gas overcomes the elastic strength of bellows 116 and deforms bellows 116 such that it expands along its cylindrical axis, providing a stroke. Depending upon the application of the actuator, the end configuration of bellows 116 performs a function upon expansion. For instance, when the end configuration is a blade, bellows 116 cuts something upon expansion. As stated above, bellows can withstand at least 3,000 psi of pressure. The initiator is consumed in the propellant burning process.

Figure 2:
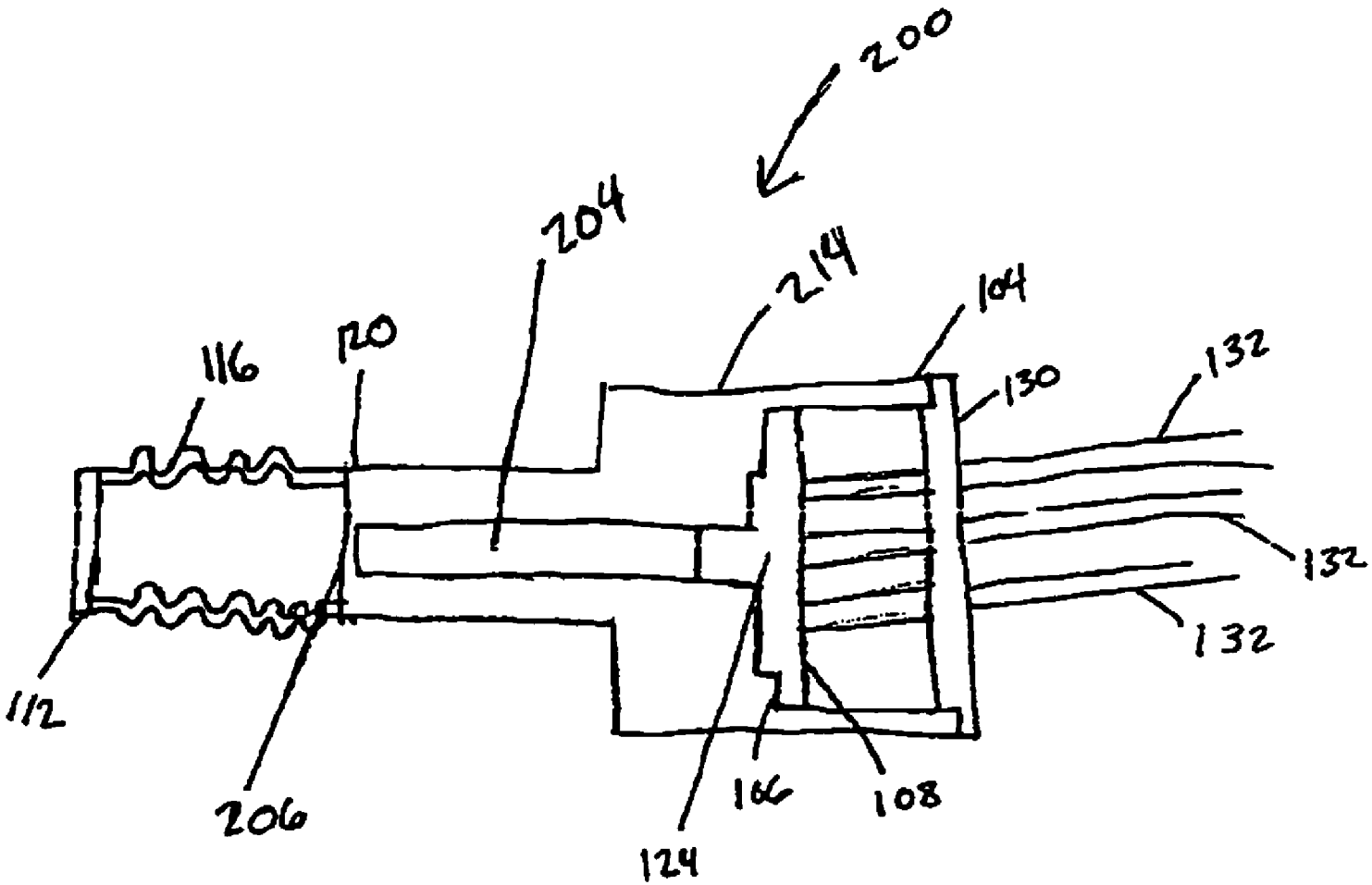
FIG. 2 is a cross-sectional side view of a further embodiment of an actuator assembly.

FIG. 2 illustrates a cross-sectional side view of a further embodiment of an actuator, assembly 200 which differs from actuator assembly 100 in that it further includes a compartment 204 in a housing body 214. Compartment 204 provides a place to add supplemental pyrotechnic material when higher pressures are required for initiation. Compartment 204 includes an integral closure 206 that is blasted off during initiation. Integral closure 206 eliminates the need for a separate closure, welding, and leak testing. The advantage of having compartment 204 in housing body 214 is modularity and reduced costs. When supplemental pyrotechnic material is needed, bellows 116 and chip initiator 124 do not need to be modified, which results in a cost savings. With the addition of compartment 204, standard sizes may be used for all the components of actuator assembly 200 and adding supplemental pyrotechnic material may be accomplished by substituting housing body 214 for housing body 114.

Figure 3:
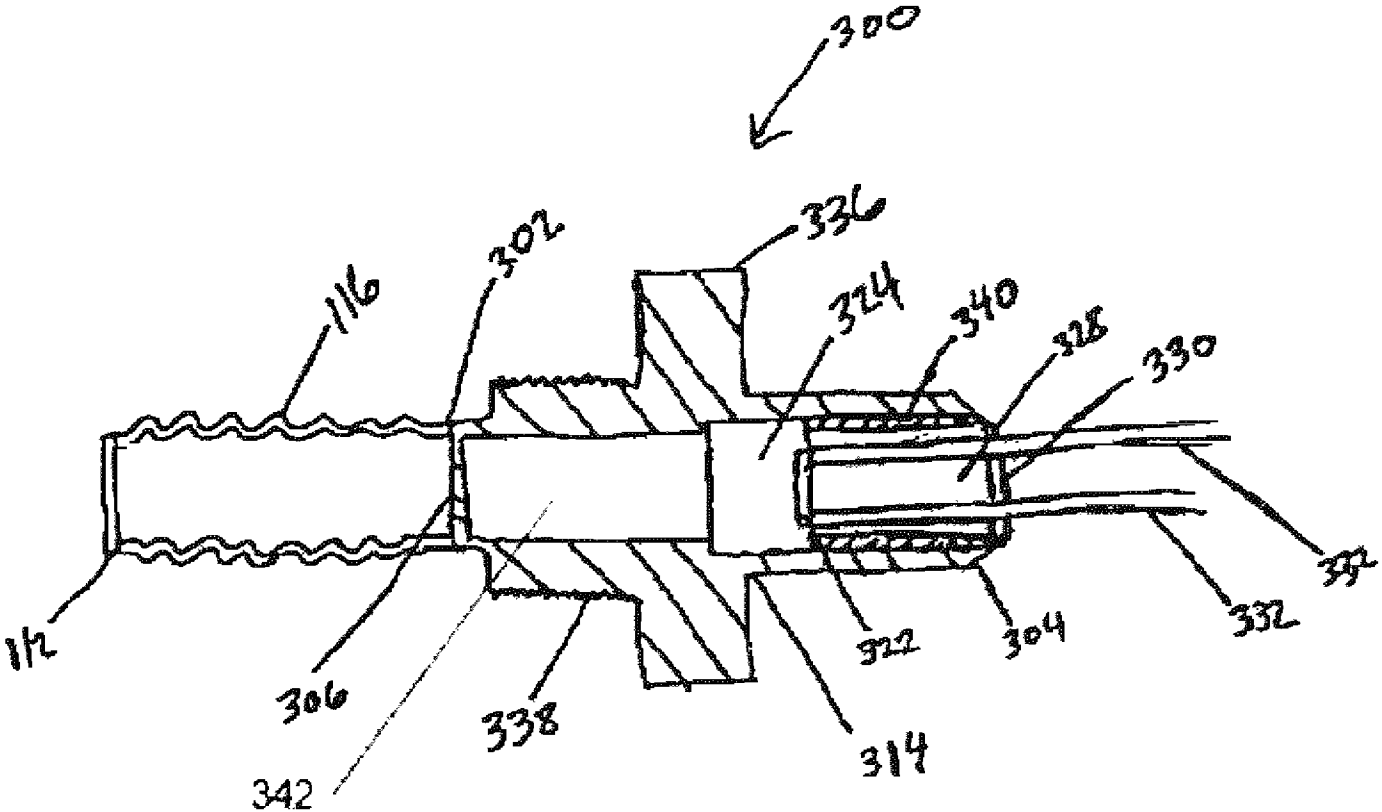
FIG. 3 is a cross-sectional side view of a further embodiment of an actuator assembly.

FIG. 3 illustrates an embodiment with a different type of initiator from chip initiator 124 of the embodiments of FIGS. 1 and 2. Actuator assembly 300 of FIG. 3 includes an initiator 324 that includes a receptacle having a bridge element 322 on an inside wall. Bridge element 322 may include but is not limited to a foil bridge. Prior to assembly, receptacle is filled with pyrotechnic material. The housing body 314 of this embodiment is configured to fit initiator 324. The assembly of actuator assembly 300 is similar to the assembly of actuator assembly 100 in the following steps: (1) bellows 116 is coupled to end 302 of housing body 314, (2) initiator 324 is loaded into end 304 of housing body 314, (3) housing body 314 is potted with filler material 328, and (4) cover 330 is coupled to end 304 of housing body 314 with leads 332 extending through cover 330. Assembly of actuator assembly 300 may be different from the assembly of actuator assembly 100 because a spacer 340 may be included in housing body 314 prior to loading housing body 314 with filler material 328. Then, end 304 is crimped to further secure spacer 340 within housing body 314 prior to coupling cover 330 to end 304. Spacer 340 facilitates securing initiator 324 within housing body 314. Similar to the housing body 214 of FIG. 2, a compartment 342 is provided in housing body 314. Compartment 342 includes an integral closure 306. Supplemental pyrotechnic material may be provided in compartment 342. Housing body 314 does not need to include compartment 342 in applications in which supplemental pyrotechnic material is not needed.

Housing body 314 includes flange 336 and threaded portion 338. These two features facilitate including actuator assembly 300 into another structure. A user may screw actuator assembly 300 into a threaded hole of the structure (not shown) in which the user is utilizing actuator assembly 300. Threaded portion 338 is the portion that would be screwed into the threaded hole. Flange 336 is the portion upon which a wrench or other tool could grip housing body 314 to rotate housing body 314 when screwing housing body 314 into a threaded hole of a structure (not shown). Flange 336 may be shaped as a hex nut or any other shape around which a corresponding tool may fit. Threaded portion 338 and flange 336 provide a simple, inexpensive way to include actuator assembly 300 in structures without having to add parts to actuator assembly 300.

Housing body 314 does not need to include flange 336 and threaded portion 338 in applications in which the user is not attaching actuator assembly 300 into the structure. If housing body 314 does not include flange 336 and threaded portion 338, the outer surface of housing body 314 could be a smooth cylindrical surface having a continuous diameter. The outer surface of housing body 314 could be any shape required by the structure in which it is being used.

Housing body 114 of FIG. 1 and housing body 214 of FIG. 2 could include a flange and threaded portion similar to that of housing body 314 to screw housing body 114 or housing body 214 into a structure. For instance, the outer surface of compartment 204 could be threaded and a portion of the outer surface of housing body 214 could be shaped as a hex nut. Like housing body 314, housing bodies 114 and 214 could be any shape required by the structure in which it is being used.

Figure 4B:
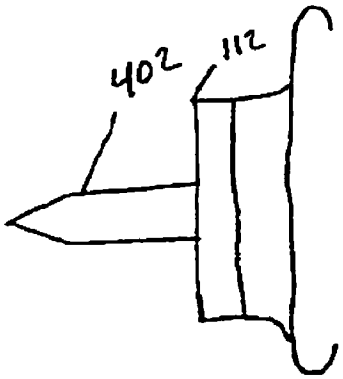
FIG. 4B is a side view of cutter.
Figure 4C:
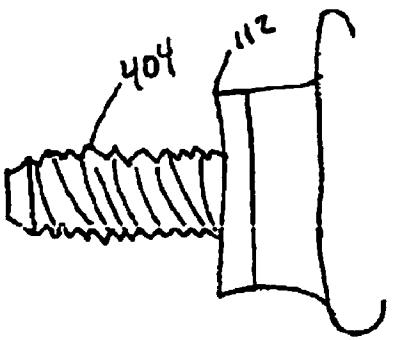
FIG. 4C is a side view of a threaded boss.
Figure 4A:
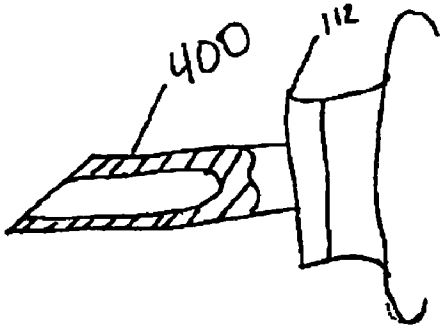
FIG. 4A is a side view of a closure puncture.

End 112 of bellows 116 may contain a variety of tools, depending upon the environment in which actuator assembly is to be used. FIGS. 4A-C illustrate potential end configurations for the bellows. For instance, bellows 116 may have a cutter 402 (FIG. 4B) on end 112 if actuator assembly is to be used as a bolt cutter. Other tools include but are not limited to a valve, a closure puncture 400 with a thru hole (FIG. 4A), or a threaded boss 404 (FIG. 4C). Including a tool on the end of bellows 116 reduces costs by eliminating the need for more parts and modification. Threaded boss 404 could be used to attach threaded tools to end 112, so that actuator assembly can easily be adapted to each application. With threaded boss 404, a threaded cutter or a threaded closure puncture could be screwed onto end 112. End 112 is hermetically sealed, so there is no need for the threaded connection between threaded boss 404 and the threaded tool to be hermetic. By providing an interchangeable way of connecting tools to end 112, costs are reduced and the user does not have to commit to a specific use for the actuator assembly upon purchasing. For instance, if a person buys an actuator assembly 100 with a closure puncture on end 112 and the person later realizes he needs an actuator assembly 100 with a cutter on end 112, he would have to buy another actuator assembly 100, this one providing a cutter on the end. However, if the person had originally bought an actuator assembly 100 with a threaded boss 404 and a separate threaded closure puncture, he would only have to buy a threaded cutter once he realized that he needed a cutter rather than a closure puncture. A threaded cutter is likely to be less expensive than an actuator assembly. Therefore, the person saves money by buying an actuator assembly having a threaded boss 404 and two threaded tool ends rather than two actuator assemblies having different tool ends. Another option is for end 112 to be flat, as it appears in FIGS. 1-3, when bellows 116 is to be used as a thruster or switch actuator.

Other embodiments, extensions, and modifications of the ideas presented above are comprehended and should be within the reach of one versed in the art upon reviewing the present disclosure. Accordingly, the scope of the present invention in its various aspects should not be limited by the examples presented above. The individual aspects of the present invention and the entirety of the invention should be regarded so as to allow for such design modifications and future developments within the scope of the present disclosure.

What is claimed is:

1. An actuator comprising:

a chamber;

a bellows being coupled to the chamber and including a cylindrical axis;

an internal surface cincturing the cylindrical axis; and a tool end configured to be displaced along the cylindrical axis in response to internal pressure expanding the bellows; and an initiator being disposed in the chamber;

wherein a void extends between the cylindrical axis and the internal surface.

2. The actuator of claim 1, wherein the bellows can withstand at least 3,000 psi of internal or external pressure without rupturing.

3. The actuator of claim 1, wherein the initiator is an integrated circuit chip initiator.

4. The actuator of claim 3, wherein the integrated circuit receives digital signals through leads extending outside the actuator.

5. The actuator of claim 4, wherein the integrated circuit receives digital signals to trigger the initiator to expand the bellows.

6. The actuator according to claim 1, wherein the tool end comprises at least one of a cutter, a closure puncture, and a threaded boss.

7. The actuator according to claim 1, wherein the tool end includes a first coupling and a tool includes a second coupling.

8. The actuator according to claim 7, wherein the first and second couplings comprise cooperative threaded couplings.

9. The actuator according to claim 7, wherein the first coupling is interchangeably coupled with each of a plurality of the second couplings.

10. The actuator according to claim 1, wherein the internal pressure expanding the bellows is in response to firing the initiator.

11. The actuator according to claim 1, wherein a cross-section of the void perpendicular to the cylindrical axis comprises a circular boundary defined by the interior surface.

12. The actuator according to claim 11, wherein the circular boundary is concentric with the cylindrical axis.

13. The actuator according to claim 11, wherein the cross-section of the void comprises a circular disk.

14. The actuator according to claim 1, wherein the internal surface is concentric with the cylindrical axis.

15. The actuator according to claim 1, wherein the void comprises a space without an element translating along the cylindrical axis.

* * * * *